US006349711B1

(12) United States Patent
Perry et al.

(10) Patent No.: US 6,349,711 B1
(45) Date of Patent: Feb. 26, 2002

(54) LOW PRESSURE ELECTRICALLY OPERATED PNEUMATIC PAINTBALL GUN

(75) Inventors: Rod Perry, Greenburg; William Gardner, Jr., Lingonier Township, both of PA (US)

(73) Assignee: Smart Parts, Inc., Latrobe, PA (US)

( * ) Notice: Subject to any disclaimer, the term of this patent is extended or adjusted under 35 U.S.C. 154(b) by 0 days.

(21) Appl. No.: 09/528,752

(22) Filed: Mar. 20, 2000

(51) Int. Cl.[7] ..... F41B 11/00
(52) U.S. Cl. ..... 124/73; 124/77
(58) Field of Search ..... 124/73, 75, 77

(56) References Cited

U.S. PATENT DOCUMENTS

| | | | | |
|---|---|---|---|---|
| 2,304,320 A | | 12/1942 | Tratsch | 124/77 |
| 2,554,116 A | | 5/1951 | Monner | 124/11 |
| 2,568,432 A | | 9/1951 | Cook | 124/77 |
| 2,594,240 A | | 4/1952 | Wells | 124/13 |
| 2,634,717 A | | 4/1953 | Junkin | 124/11 |
| 2,834,332 A | | 5/1958 | Guthrie | 124/77 |
| 2,845,055 A | | 7/1958 | Collins et al. | 124/32 |
| 2,845,805 A | | 7/1958 | Collins et al. | 124/77 |
| 3,089,476 A | | 5/1963 | Wolverton | 124/77 |
| 3,192,915 A | | 7/1965 | Norris et al. | 124/77 |
| 3,662,729 A | | 5/1972 | Henderson | 124/73 |
| 3,695,246 A | | 10/1972 | Filippi et al. | 124/77 |
| 3,921,980 A | | 11/1975 | Artzer | 124/77 |
| 4,094,294 A | | 6/1978 | Speer | 124/56 |
| 4,362,145 A | | 12/1982 | Stelcher | 124/32 |
| 4,770,153 A | | 9/1988 | Edelman | 124/77 |
| 4,819,609 A | | 4/1989 | Tippmann | 124/72 |
| 4,899,717 A | | 2/1990 | Rutten et al. | 124/32 |
| 4,936,282 A | | 6/1990 | Dobbins et al. | 124/74 |
| 5,228,427 A | | 7/1993 | Gardner, Jr. | 124/71 |
| 5,280,778 A | | 1/1994 | Kotsiopoulos | 124/73 |
| 5,285,765 A | | 2/1994 | Lee | 124/50 |
| 5,333,594 A | | 8/1994 | Robinson | 124/73 |
| 5,383,442 A | | 1/1995 | Tippmann | 124/76 |
| 5,664,552 A | * | 9/1997 | Kunimoto | 124/73 |
| 5,755,213 A | | 5/1998 | Gardner | 124/73 |
| 5,878,736 A | * | 3/1999 | Lotuaco, III | 124/71 |
| 5,881,707 A | | 3/1999 | Gardner et al. | 124/77 |
| 5,908,024 A | * | 6/1999 | Staev | 124/71 |
| 5,967,133 A | | 10/1999 | Gardner et al. | 124/77 |
| 6,003,504 A | | 12/1999 | Rice et al. | 124/73 |
| 6,035,843 A | * | 3/2000 | Smith et al. | 124/77 |

FOREIGN PATENT DOCUMENTS

| | | |
|---|---|---|
| GB | 2146416 | 4/1985 |
| WO | WO 97/26498 | 6/1997 |

* cited by examiner

*Primary Examiner*—Charles T. Jordan
*Assistant Examiner*—John W. Zerr
(74) *Attorney, Agent, or Firm*—Marger Johnson & McCollom, P.C.

(57) ABSTRACT

A paintball gun according to this invention comprises a pressure regulator, an electronic solenoid valve, a firing valve assembly, a pneumatic ram assembly, and a firing chamber. The pressure regulator is configured to provide low pressure gas to a solenoid valve to control loading and firing operations of the paintball gun. The pressure regulator is further configured to supply low pressure gas to the firing chamber via operation of the firing valve assembly during a firing operation. The firing valve assembly can be configured with an opening, a valve chamber, and an exit port in fluid communication with the firing chamber, each having a size sufficient to allow an appropriate volume of gas flow to be supplied to the firing chamber with no significant drop-off in pressure. The firing valve assembly can also be provided with an o-ring seated around the valve cap to provide sensitivity to the firing valve, allowing it to open and close quickly in order to ensure near instantaneous shutoff with minimal load. The firing valve assembly is opened by the operation of the pneumatic ram assembly during a firing operation. The pneumatic ram assembly may also be connected to a bolt assembly via a mechanical assembly to perform a loading operation.

20 Claims, 4 Drawing Sheets

LOW PRESSURE ELECTRICALLY OPERATED PNEUMATIC PAINTBALL GUN

BACKGROUND OF THE INVENTION

This invention relates generally to paintball guns with loading and firing operations controlled electronically through a solenoid. More specifically, this invention relates to a paintball gun that uses a pressure regulator to supply low pressure gas to both the solenoid and a firing chamber.

The industry has been unable to provide a simple, electrically-controlled, pneumatic paintball gun because, traditionally, high pressure gas has been required to launch a paintball from the gun, while low pressure gas is required for the solenoid-controlled loading and launch initiation (firing) operations. In the prior art paintball guns, therefore, two pressure regulators are generally required. U.S. Pat. No. 6,003,504, issued to Rice, et al. (Rice), describes one such gun having two separate pressure regulators for regulating gas from a high pressure gas source. Specifically, Rice discloses a paintball gun having a low pressure regulator that supplies gas of a pressure of around 80–90 psi to an electrically-controlled solenoid. The solenoid, in turn, controls movement of a pneumatic ram to control loading and firing operations of the gun. A high pressure regulator is also required, however. The high pressure regulator is used to supply gas having a pressure of around 400–600 psi to launch a paintball from a firing chamber during the firing operation. Although Rice suggests, in the concluding paragraph of the written description, that the same "high" pressure gas can be used in the pneumatic control circuit as well as in the high pressure chamber, Rice does not explain how to accomplish this. The BushMaster 2000 model paintball gun, manufactured by Indian Creek Design of Nampa, Id., is another example of a paintball gun having separate high and low pressure regulators for solenoid-controlled operations and paintball launching, respectively.

In addition to the added complexity of having dual pressure regulators, launching paintballs using high pressure gas has many of its own disadvantages. For instance, high pressure launching frequently results in the paintballs breaking within the firing chamber or within a barrel of the gun. High pressure launching also generally causes deformation of the paintballs leading to inaccuracy in aiming.

U.S. Pat. No. 5,881,707 (the '707 patent) and U.S. Pat. No. 5,967,133 (the '133 patent), both issued to Gardner, et al, disclose electrically-operated pneumatic paintball guns that use a low pressure gas to launch a paintball from a firing chamber in addition to performing the solenoid-controlled loading and firing operations. Although the paintball guns disclosed in these two patents offer a significant improvement in performance over dual-regulator guns that use high pressure gas for paintball launching, the '707 and '133 patent paintball guns are complex and, therefore, expensive to manufacture and repair. What is needed, therefore, is a simplified, electrically-operated, pneumatic paintball gun that uses low pressure gas for both solenoid-controlled operations and for launching the paintball. The industry would also be benefitted by a low pressure launching paintball gun which does not suffer from substantial pressure drop-off during firing.

SUMMARY OF THE INVENTION

According to the needs of the industry, one object of the present invention is to enable a paintball gun with a simplified mechanical structure that uses a low pressure regulator for launching a paintball from a firing chamber and for driving solenoid-controlled operations.

Another object of the present invention is to provide a paintball gun which uses low pressure for paintball launching, but does not suffer from significant pressure drop-off during firing.

This invention provides a significant improvement in the art by enabling a paintball gun with a simplified mechanical structure that provides the benefits of a low pressure launching mechanism. Specifically, a paintball gun according to this invention comprises a pressure regulator, an electronic solenoid valve, a firing valve assembly, a pneumatic ram assembly, and a firing chamber. The pressure regulator is configured to provide low pressure gas, regulated from a high pressure gas source, to an electronic solenoid valve in order to control a loading and a firing operation of the paintball gun. The pressure regulator is further configured to supply low pressure gas to the firing chamber via operation of the firing valve assembly in order to launch a paintball. The firing valve assembly can be configured with an opening, a valve chamber, and an exit port in fluid communication with the firing chamber, each having a flow area large enough to allow a sufficient flow of gas to be supplied to the firing chamber without significant pressure drop-off. The firing valve assembly can also be provided with an o-ring seated around the valve cap to provide sensitivity to the valve, allowing it to open and close quickly in order to ensure a near instantaneous shutoff with minimal load. The firing valve assembly is opened by the operation of the solenoid valve-controlled pneumatic ram assembly during the firing operation. The pneumatic ram assembly may also be connected to a bolt assembly via a mechanical linkage to perform the loading operation.

The foregoing and other objects, features and advantages of the invention will become more readily apparent from the following detailed description of a preferred embodiment of the invention which proceeds with reference to the accompanying drawings.

DETAILED DESCRIPTION

Figure 1:
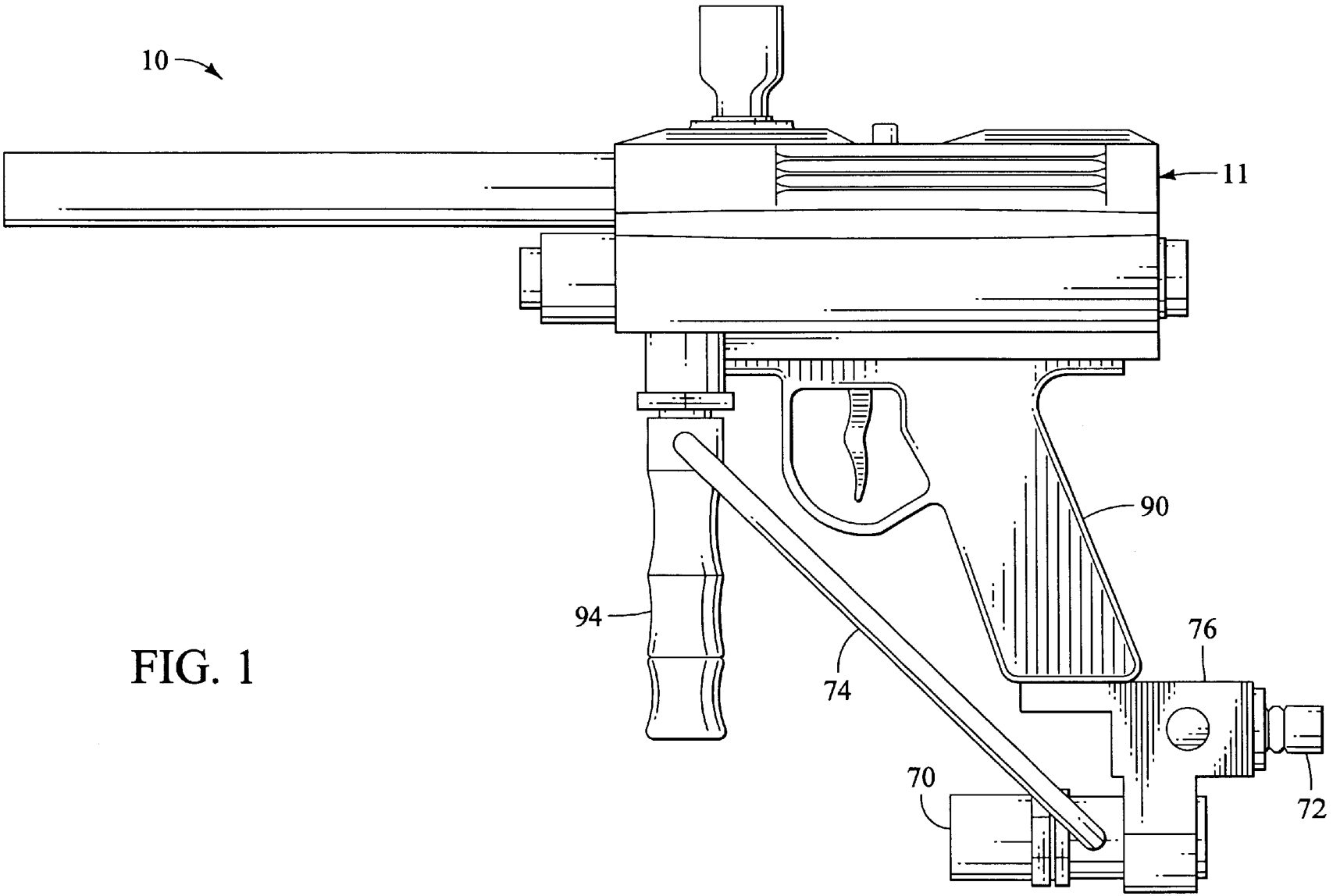
FIG. 1 is a side elevation view of an electrically-controlled pneumatic paintball gun according to a preferred embodiment of the present invention.

FIG. 1 is an external side elevation view of an electrically-controlled pneumatic paintball gun 10 according to a preferred embodiment of the present invention. Referring to FIG. 1, the electrically-controlled pneumatic paintball gun 10 has a body 11, generally configured in a handgun shape, including a grip frame 90 and a handle 94. The gun 10 is configured to receive pressurized gas from a high pressure gas source (not shown) through a pressure regulator 70. Specifically, the high pressure gas source is connected to the pressure regulator 70 through a bottle connection 72. The pressurized gas can be $CO_2$, compressed air, or any other pressurized gas suitable for use in a paintball gun. The preferred gas, however, is $CO_2$. In operation, the pressure regulator 70 converts a supply of high pressure gas from the high pressure gas source (i.e., having a pressure of between about 1,200 to about 5,000 psi) into a low pressure gas supply (i.e., having a pressure of between about 85 to about 300 psi, and preferably between about 160 to about 180 psi). The low pressure gas supply is then provided via a hose 74 to the internal gun components.

Figure 2:
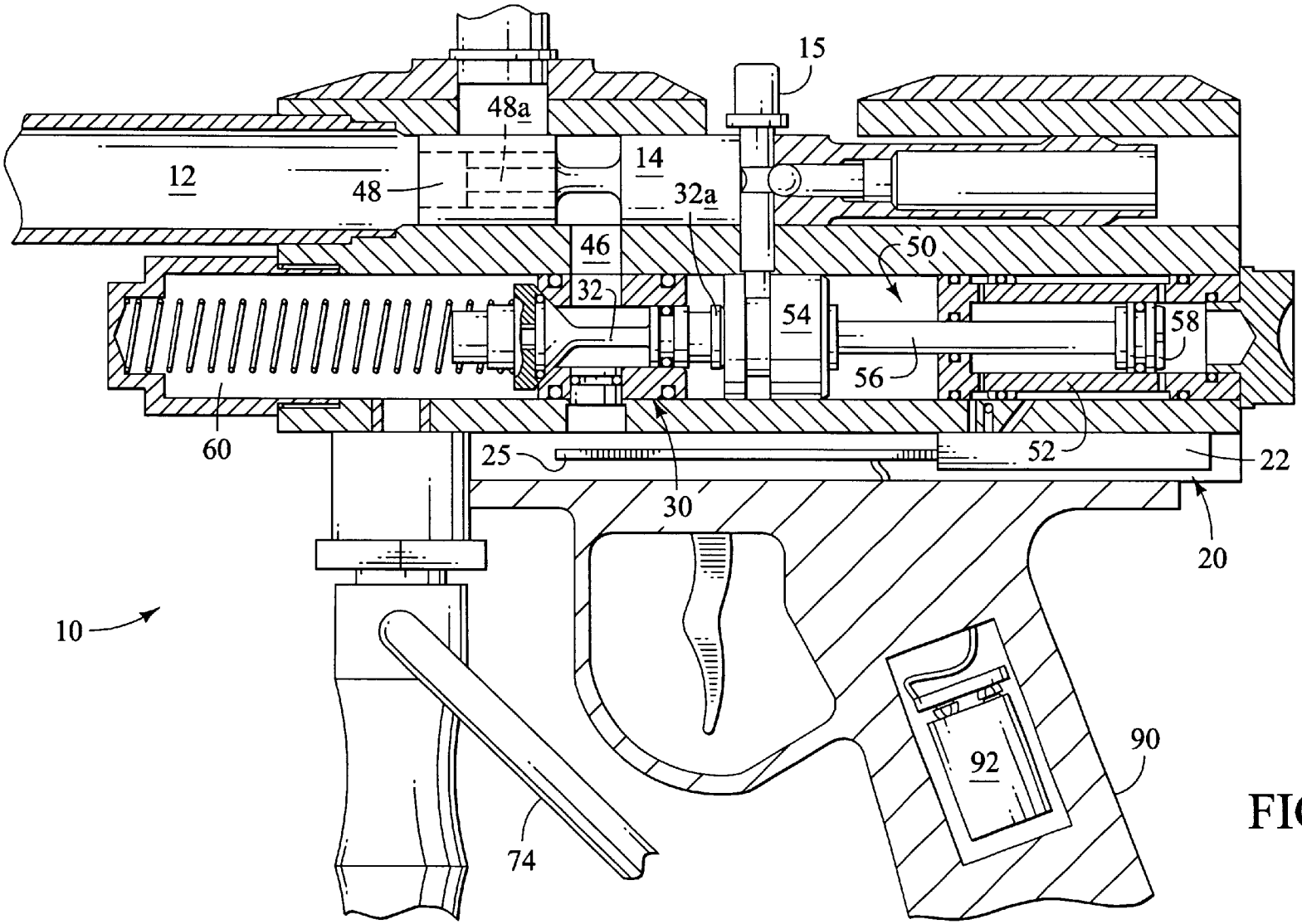
FIG. 2 is a vertically cross-sectioned side elevation view of the electrically-controlled pneumatic paintball gun of FIG. 1.

FIG. 2 is a vertically cross-sectioned side elevation view of the electrically-controlled pneumatic paintball gun 10 of FIG. 1, showing the internal gun components. Referring now to FIGS. 1 and 2, internal components of the electrically-controlled pneumatic paintball gun 10 include a firing chamber 12, a loading (bolt) assembly 14, an electronic solenoid valve assembly 20, a firing valve assembly 30, a pneumatic ram assembly 50, and a low pressure gas storage chamber 60, among other things. According to this invention, the storage chamber 60 receives the low pressure gas from the pressure regulator 70 through the hose 74. The low pressure gas in the storage chamber 60 can then be used to launch a paintball. Additionally, because the gas from the pressure regulator 70 is supplied to the gun 10 at a low pressure, it can also be used directly in the electronic solenoid valve assembly 20. The need for separate high and low pressure regulators is thereby avoided by this invention.

The electronic solenoid valve assembly 20 preferably comprises an electronic 4-way solenoid valve 22 that controls a flow of low pressure gas from the regulator 70 to operate the pneumatic ram assembly 50. The operation of the electronic 4-way solenoid valve 22 is controlled electrically by a circuit board 25. A power source, such as a 9-volt battery 92, supplies power to the circuit board 25. The power source 92 is preferably located in the grip frame 90 of the paintball gun 10. As is well known in the art, a trigger-actuated microswitch or other electronic actuation mechanism can be used to transmit a signal to the circuit board to initiate an operation of the solenoid valve 22.

The construction and operation of the electronic solenoid valve assembly 20, the pneumatic ram assembly 50, and the loading mechanism 14 are generally known in the art, but will be described briefly. The pneumatic ram assembly 50 includes a piston cylinder 52, a head (or hammer) 54, a rod 56, and a piston 58. The rod 56 and piston 58 can be formed integrally. In operation, the low pressure gas is supplied to ports along the piston cylinder 52 of the pneumatic ram assembly 50 from the electronic 4-way solenoid valve 22 in order to drive the piston 58 forward or backward.

A loading operation takes place by first supplying the low pressure gas to an area E in front of the piston 58 and simultaneously venting an area D behind the piston 58, driving the piston backwards. The piston 58 is connected to the head 54 via the rod 56. The head 54 is further connected to the bolt assembly 14 via a mechanical linkage 15. Accordingly, as the piston 58 is driven backwards, the head 54 retracts toward the piston cylinder 52 and draws the bolt assembly 14 into an open position. While the bolt assembly 14 is open, a paintball is allowed to drop into the firing chamber 12. Next, low pressure gas is supplied to an area D behind the piston 58, while the area E in front of the piston 58 is vented, thereby driving the piston 58 forward, toward the front of the gun. Accordingly, the head 54 and bolt assembly 14 are also driven forward, loading the paintball into a firing position within the firing chamber 12.

A firing operation, which initiates a launching of the paintball, takes place at the end of the loading operation. Specifically, as the piston 58 reaches its forward position, the hammer 54 strikes a protruding end 32A of a valve pin 32 of the firing valve assembly 30. As the pin 32 is struck, the firing valve 30 opens and releases the low pressure gas from the gas storage chamber 60 into the firing chamber 12, thereby launching the paintball. The area of piston 58 that is exposed to the pressurized gas in chamber D should be configured with a size that ensures that a correct force is applied to the valve pin 32 to enable smooth and precise opening of the firing valve assembly 30. The preferred diameter of the piston 58 according to this embodiment is 0.375 inches.

Figure 3:
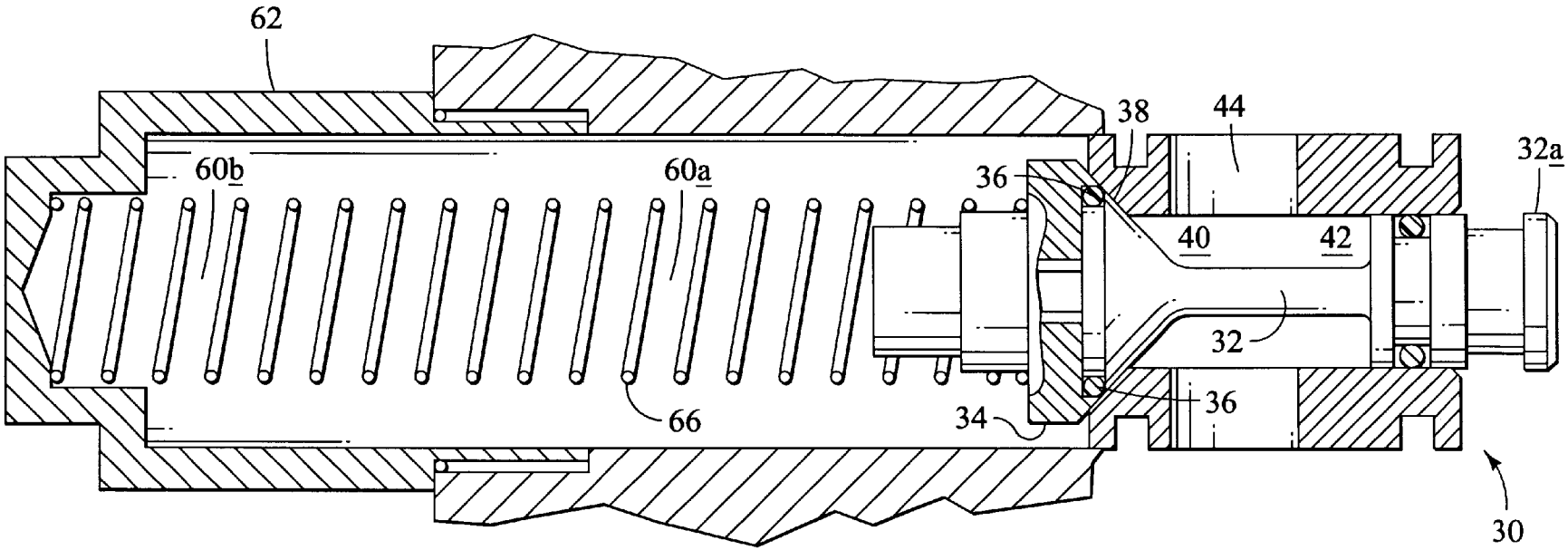
FIG. 3 is an exploded cross-sectional side elevation view of a low pressure gas storage chamber and a firing valve assembly in the electrically-controlled pneumatic paintball gun of FIG. 1, showing a relationship between the gas storage chamber and the firing valve assembly.

FIG. 3 is an exploded cross-sectional side elevation view of a low pressure gas storage chamber 60 and a firing valve assembly 30 in the electrically-controlled pneumatic paintball gun of FIG. 1, showing a relationship between the gas storage chamber 60 and the firing valve assembly 30. Although using a gas storage chamber to supply high pressure gas to the firing chamber through a firing valve exists in the prior art, this invention is unique in its use of the gas storage chamber 60 to supply low pressure gas to the firing chamber 12 via the firing valve assembly 30. The sizing of the gas storage chamber 60 and the components of the firing valve assembly 30 are important in facilitating the use of low pressure gas for launching the paintball. The gas storage chamber 60, for example, must contain the appropriate volume C of low pressure gas in order to ensure that a proper flow of gas is supplied to the paintball for launching.

Figure 4:
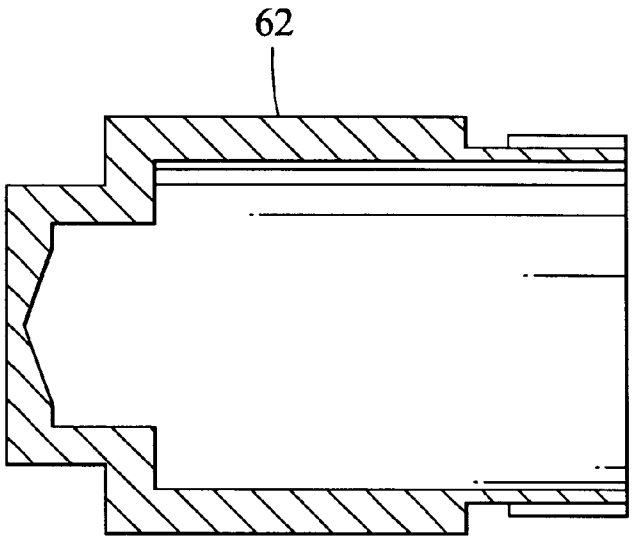
FIG. 4 is an exploded cross-sectional side elevation view of an end cap of the low pressure gas storage chamber used in the electrically-controlled pneumatic paintball gun of FIG. 1 for storing low pressure gas for launching a paintball.

As shown in FIG. 3, the gas storage chamber 60 is partially formed from a cavity 60A within the body 11 of the gun 10. Additionally, however, the gas storage chamber 60 is formed from an end cap 62 that attaches to the front of the gun 10, e.g., by threaded engagement, and has a cavity 60B in communication with the cavity 60A. These two cavities 60A, 60B together form the gas storage chamber 60. FIG. 4 is an exploded cross-sectional side elevation view of the end cap 62 showing its preferred dimensions. The end cap 62 helps provide the appropriate storage volume C in the low pressure gas storage chamber 60 by providing a cavity 60B that forms part of the storage chamber 60. In the preferred embodiment, the storage chamber 60 contains approximately 1.65 $in.^3$ of gas at about 170 psi. In operation, low pressure gas from the pressure regulator 70 is supplied to and fills the gas storage chamber 60. The low pressure gas remains in the storage chamber 60 until the firing valve 30 is opened. When the firing valve assembly 30 is open, gas from the storage chamber 60 rushes into the firing chamber 12 to launch the paintball.

Figure 5:
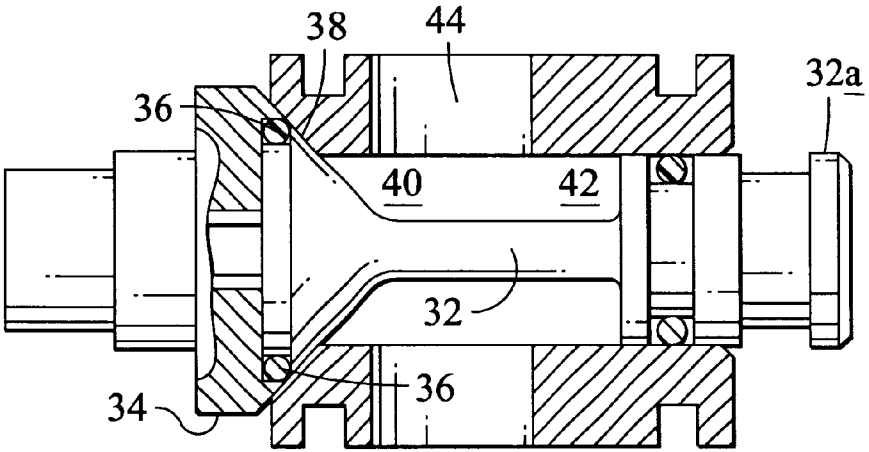
FIG. 5 is an exploded cross-sectional side elevation view of the firing valve assembly used in the electrically-controlled pneumatic paintball gun of FIG. 1 for quickly supplying a sufficient volume of gas to a firing chamber to launch a paintball without significant pressure drop-off.

FIG. 5 is an exploded cross-sectional side elevation view of a firing valve assembly 30 according to this invention. Although firing valves exist in the prior art, the firing valve assembly of this invention 30 is unique in its particular design. Particularly, because the paintball gun 10 of this invention launches the paintball using low pressure, the valve assembly 30 must be configured to allow the low pressure gas to be supplied to the paintball rapidly and in high volume in order to supply the force necessary for launching. This is achieved by maximizing a flow area between the low pressure gas storage chamber 60 and the firing chamber 12.

The design and operation of the firing valve assembly 30 will now be described in detail with reference to FIG. 5. Of particular interest, the valve assembly 30 according to this invention is provided with an o-ring 36 around a valve cap 34. The o-ring 36 provides a sensitive interface between the valve cap 34 and a valve seat 38 that allows the valve 30 to open and close quickly. This helps ensure that the low pressure gas from the storage chamber 60 will be supplied to the firing chamber 12 quickly and uniformly, with no significant drop-off in pressure. Further important to this invention, a valve opening 40, a valve chamber 42, and a valve port 44 each have a size large enough to allow the low pressure gas from the storage chamber 60 to be supplied to the firing chamber 12 with minimal pressure loss when the valve 30 is opened. As shown in FIG. 5, the opening 40 has a preferred diameter of about 0.47 inches, and the exit port 44 has a preferred diameter of about 0.38 inches. The flow area in the valve chamber 42 is also maximized, having a diameter of about 0.47 inches. Accordingly, pressure loss between the low pressure gas storage chamber 60 and the firing chamber 12 during launching of the paintball is reduced.

Referring to FIGS. 2–5, a firing operation of the paintball gun 10 will now be described in detail. As noted previously, during a firing operation, the hammer 54 of the pneumatic ram assembly 50 strikes an end 32A of the valve pin 32 to initiate the launching of the paintball from the firing chamber 12. Specifically, as the head 54 strikes the pin 32, the o-ring 36 of valve cap 34 is unseated from the valve seat 38, thereby opening the firing valve 30. Gas from the low pressure gas storage chamber 60 is thereby allowed to travel through the valve opening 40, into the valve chamber 42, and out the valve exit port 44. The gas is then delivered up through a flow aperture 46 in the gun body 11 and on through a firing aperture 48 in the bolt assembly 14 where it enters the firing chamber 12 and launches the paintball. An interface 48A between the bolt 14 and the paintball is configured such that the low pressure gas is applied over a large area of the paintball. This application of force over a large area of the paintball allows it to be launched at a high velocity with little deformation using a relatively low pressure gas. Furthermore, because of the sizing of the flow areas (valve opening 40, valve chamber 42, valve exit port 44, flow aperture 46, firing aperture 48, and interface 48A), the low pressure gas is supplied from the gas storage chamber 60 to the paintball very quickly. Accordingly, very little pressure drop-off is experienced during the firing operation. The minimization of pressure loss ensures the uniform application of a launching force on the paintball and maximizes gun efficiency. Following the firing operation, the hammer 54 is retracted toward the piston cylinder 52. A light spring 66 exerts just enough force on the valve head 34 to ensure that the valve 30 returns to its closed position when the hammer 54 is retracted. With the valve assembly 30 closed, the storage chamber 60 then refills in preparation for the next firing operation.

Having described and illustrated the principles of the invention in a preferred embodiment thereof, it should be apparent that the invention can be modified in arrangement and detail without departing from such principles. We claim all modifications and variations coming within the spirit and scope of the following claims.

What is claimed is:

1. An electrically-controlled pneumatic paintball gun, comprising:

a pressure regulator for regulating gas from a high pressure source into a low pressure gas;

a firing valve assembly configured to receive the low pressure gas from the pressure regulator and to transmit the low pressure gas to a firing chamber during a firing operation; and an electrically-controlled solenoid valve configured to operate a pneumatic ram assembly using the low pressure gas, the pneumatic ram assembly configured to control a firing operation to launch a paintball from the firing chamber.

2. A paintball gun according to claim 1, wherein the low pressure gas comprises a pressure of between about 85 psi to about 300 psi.

3. A paintball gun according to claim 2, wherein the low pressure gas comprises a pressure of between about 140 and about 220 psi.

4. A paintball gun according to claim 1, further comprising a low pressure gas storage chamber for storing the low pressure gas from the pressure regulator in a volume sufficient to launch the paintball during the firing operation.

5. A paintball gun according to claim 4, wherein the volume of the low pressure gas storage chamber is approximately 1.65 cubic inches.

6. A paintball gun according to claim 1, further comprising a bolt assembly connected to the pneumatic ram assembly via a mechanical linkage to perform a loading operation.

7. A paintball gun according to claim 6, wherein the pneumatic ram assembly is configured to perform the loading operation of the paintball gun by moving the bolt assembly backwards to allow the paintball to drop into the firing chamber and forwards to move the paintball into a firing position within the firing chamber.

8. A paintball gun according to claim 1, wherein the pneumatic ram assembly is configured to control a firing operation of the paintball gun by striking a valve pin of the firing valve assembly to open the firing valve assembly and to allow gas from the pressure regulator to be supplied to the firing chamber.

9. A paintball gun according to claim 1, wherein the firing valve assembly comprises:

a valve opening;

a valve chamber;

a valve exit port; and wherein the valve opening, valve chamber, and valve exit port each have a size sufficient to allow gas to be supplied from the low pressure regulator to the firing chamber without a significant pressure drop-off.

10. A method of launching a paintball from a paintball gun comprising a pressure regulator, a firing valve assembly, an electronic solenoid valve, a pneumatic ram assembly, and a firing chamber housing the paintball, the method comprising:

supplying low pressure gas from the pressure regulator to the firing valve assembly;

supplying low pressure gas from the pressure regulator to the electronic solenoid valve;

using the low pressure gas supplied to the electronic solenoid valve to initiate a firing operation through the operation of the pneumatic ram assembly; and launching the paintball from the paintball gun by opening the firing valve assembly to transmit the low pressure gas supplied to the firing valve assembly to the firing chamber.

11. A method of launching a paintball according to claim 10, wherein supplying low pressure gas from the pressure regulator to the firing valve assembly further comprises supplying low pressure gas from the pressure regulator to a gas storage chamber in fluid communication with the firing valve assembly.

12. A method of launching a paintball according to claim 10, wherein using the low pressure gas supplied to the electronic solenoid valve to initiate a firing operation by operating the pneumatic ram assembly comprises driving a head of the pneumatic ram assembly into contact with a valve pin of the firing valve assembly to open the firing valve assembly.

13. A method of launching a paintball according to claim 10, further comprising using the low pressure gas supplied to the electronic solenoid valve to initiate a loading operation by operating the pneumatic ram assembly.

14. A method of launching a paintball according to claim 10, wherein launching the paintball from a paintball gun by opening the firing valve assembly to transmit the low pressure gas supplied to the firing valve assembly to the firing chamber further comprises transmitting the low pressure gas through the firing valve assembly to the firing chamber without significant pressure drop-off.

15. A method of constructing a paintball gun, comprising:

providing a pressure regulator for regulating gas from a high pressure gas source into a low pressure gas supply;

providing one or more pneumatic ram assemblies for controlling a loading and a firing operation of the paintball gun;

providing one or more electronic solenoid valves for controlling the pneumatic ram assembly or assemblies using the low pressure gas supply; and providing a firing valve assembly for transmitting low pressure gas from the low pressure gas supply to a firing chamber during the firing operation.

16. A method of constructing a paintball gun according to claim 15, further comprising:

providing a low pressure gas storage chamber in fluid communication with the firing valve assembly to receive and store low pressure gas from the pressure regulator and to supply a known volume of low pressure gas to the firing chamber during the firing operation.

17. A method of constructing a paintball gun according to claim 16, further comprising:

sizing a valve opening, a valve chamber, and a valve port of the firing valve assembly such that the low pressure gas is supplied from the low pressure gas storage chamber to the firing chamber without a substantial pressure drop-off.

18. A method of constructing a paintball gun according to claim 15, further comprising:

configuring a valve cap of the firing valve assembly to enhance sensitivity of the firing valve assembly by enabling quick opening and near instantaneous closing of the firing valve assembly with minimal load.

19. A method of constructing a paintball gun according to claim 18, wherein configuring a valve cap of the firing valve assembly to enhance sensitivity of the firing valve assembly comprises providing the valve cap with an o-ring.

20. A method of constructing a paintball gun according to claim 15, further comprising:

configuring a surface area of a piston in the pneumatic ram assembly to communicate with low pressure gas from the low pressure gas supply such that a correct force is applied from a head of the pneumatic ram assembly to a valve pin of the firing valve assembly during the firing operation to enable smooth and precise opening of the firing valve assembly.

* * * * *